US005155461A

United States Patent [19]

Teerman et al.

[11] Patent Number: 5,155,461

[45] Date of Patent: Oct. 13, 1992

[54] SOLENOID STATOR ASSEMBLY FOR ELECTRONICALLY ACTUATED FUEL INJECTORS AND METHOD OF MANUFACTURING SAME

[75] Inventors: Richard F. Teerman, Wyoming; Robert D. Straub, Lowell; Roger L. Wolfsen, Coopersville; Leland Haines, Northville, all of Mich.

[73] Assignee: Diesel Technology Corporation, Grand Rapids, Mich.

[21] Appl. No.: 653,347

[22] Filed: Feb. 8, 1991

[51] Int. Cl.[5] ..... H01F 3/00; H01F 7/08

[52] U.S. Cl. ..... 335/260; 335/278; 336/96; 29/602.1

[58] Field of Search ..... 335/260, 278, 281, 292, 335/294; 336/96; 29/602.1; 264/272.19, 272.2

[56] References Cited

U.S. PATENT DOCUMENTS 4,568,021 2/1986 Deckard et al. .

FOREIGN PATENT DOCUMENTS 1055490 10/1964 United Kingdom .

*Primary Examiner*—Harold Broome

[57] ABSTRACT

A solenoid stator assembly for electronically actuated fuel injectors is disclosed as having an E-shaped stator core including a top portion and three parallel pole pieces extending orthogonally therefrom. The outer pole pieces each have an outermost side, and each of the three pole pieces has a distal end, a face being formed across the distal end. Each of the outer pole pieces has an attachment slot formed across its outermost side proximate its distal end. A coil of electric wire is disposed around an insulating spool disposed on the central pole piece, and leads from the coil are connected to terminals. A flange on one end of the spool exerts outward forces on the outer pole pieces, prestressing them to resist further flexing caused by outwardly directed forces applied by errant fuel under pressure. An insulating cover is molded around the solenoid stator assembly, enveloping it except for portions of the terminals and the faces of the pole pieces, the cover being bonded to at least the stator core. The cover is molded into the attachment slots in the outer pole pieces to enhance adherence of the cover material to the stator core and provide a barrier to any tendency of errant fuel attempting to traverse the interface between the insulating cover and outermost side of each outer pole piece.

67 Claims, 3 Drawing Sheets

SOLENOID STATOR ASSEMBLY FOR ELECTRONICALLY ACTUATED FUEL INJECTORS AND METHOD OF MANUFACTURING SAME

TECHNICAL FIELD

This invention relates to solenoid stator assemblies for solenoid-actuated fuel injectors, particularly for engines.

BACKGROUND ART

Mechanically actuated fuel injector units have been in use for many years. Continually increasing demands for improvements in vehicle performance and fuel economy, however, have escalated the need for more sophisticated fuel injection systems. Microprocessor technology has become not only a cost-effective means for meeting the demands of the present but appears to have the potential for meeting those of the future.

Associated with the application of microprocessor technology has been the development of electronically actuated fuel injectors. The development coincides with the steady increase in the total drive train reliability provided by the industry to reduce maintenance cost and regular maintenance frequency. Electronically controlled fuel injectors have the advantage of being compatible with the electronically controlled engines used in the general transport industry and have been adopted by major producers of engines.

A typical mechanically actuated fuel injector has a plunger that is reciprocatingly driven within a bore, or bushing, by, for example, a camshaft and rocker arm assembly, to provide injection pressure. Injection timing and fuel metering are controlled by helices and ports disposed in the plunger and associated bushing.

In a typical electronically actuated fuel injector, such as shown in U.S. Pat. No. 4,568,021, assigned to the assignee of the present invention, injection pressure is provided by a mechanically operated plunger; but a solenoid is used to actuate a valve to control injection timing and fuel metering.

It is as a result of the transfer of control of the timing and metering from mechanical to electronic means that improvements in fuel injection system operation under microprocessor control have been feasible. Included among additional advantages of electronically controlled fuel injectors are fewer moving parts, less weight, less maintenance as a result of there being fewer service adjustments required to compensate for mechanical wear, and less cost.

However, one design area requiring special attention is that of assuring the integrity of the solenoid stator assembly from any deleterious effects of it being exposed to the fuel, which is under exceedingly high pressures, in the order of 2,000 pounds per square inch. Each interface of the stator core with the phenolic housing and phenolically enshrouded coil on the center pole piece is subjected to fuel under high pressure which will work to separate the assembly at the interface, which may lead to hairline fractures in the phenolic housing and require its replacement. Applicants' initial commercially practical design modifications included providing the outer side of each outer pole piece with a T-shaped groove such that, when the phenolic housing was molded about the stator and coil subassembly, the housing was mechanically interlocked with the stator. This improved the overall durability of the assembly; but over time the high pressure fuel, primarily at the remaining pole piece interfaces with the phenolic insulating material, continued to adversely effect durability.

In part, the problem associated with the accessibility of high pressure fuel to these interfaces was exacerbated by the process with which the phenolic insulating material was molded about the stator and coil subassembly. This process included locating the stator and coil subassembly within the mold by means of vertically extending locating pins received within locating holes formed within a phenolic washer positioned between the pole pieces at the distal ends thereof. The locating holes provided a flow path by which the high pressure fuel gained access to the interior interfaces of the pole pieces, which over time could work a separation at these interfaces.

Thus, with the known solenoid stator assemblies, the insulating cover material, which relies solely on the strength of the bond between it and the stator core, may become separated from the stator core and show hairline fractures as a result of the fuel being forced between the stator core and the cover material, due to portions of the stator core to which the cover material is bonded being flexed, and due to cavitation erosion associated with fluid dynamics between a reciprocating armature and the stator core.

In part also, the problem associated with the accessibility of high pressure fuel to these interfaces and the propagation of hairline fractures was exacerbated by the material characteristics of the phenolic used for the housing and coil spool, which were found to be susceptible to swelling when exposed to methanol fuel especially, and to a lesser extent, diesel fuel.

SUMMARY OF THE INVENTION

An object of the present invention is to eliminate any deleterious effects of fuel under high pressure on the bonding of an electrically insulating cover material to the solenoid stator core of an electronically actuated fuel injector.

It is a further object of the present invention to provide a solenoid stator assembly which is impervious to fuel at every interface of insulating material with the stator-coil subassembly.

It is yet another object of the present invention to provide a means of locating the stator-coil subassembly within a mold so that cavities formed between stator core pole pieces are completely filled with phenolic insulating material.

It is another object of the present invention to provide a solenoid stator assembly in which the interfaces of phenolic with the stator-core assembly are not subject to disruptive forces resulting from fluctuating fuel pressures.

It is a further object of the present invention to prestress the stator-coil subassembly in such a manner that a preload exist at every interface of the phenolic insulating material with the stator-coil subassembly, including the interface across the mechanical bond at the outside surfaces of the outer pole pieces.

A further object of the present invention is to provide a solenoid stator assembly wherein the housing, coil spool and cap are selected of compatible phenolic material having low swell characteristics when exposed to any of the various fuels, but particularly methanol fuel and diesel fuel.

In realizing the aforementioned objects, the solenoid stator assembly constructed in accordance with the present invention in a preferred form comprises an E-shaped stator core that includes a top portion having a first end and a second end. A first outer pole piece extends substantially orthogonally from the first end of the top portion, a second outer pole piece extends from the second end of the top portion in a direction substantially parallel to that of the first outer pole piece, and a central pole piece extends from a region of the top portion located central to the first and second outer pole pieces and in a direction substantially parallel to those of the first and second outer pole pieces. The first and second outer pole pieces each have an outermost side; and the first and second outer pole pieces and the central pole piece each have a distal end, a face being formed across each distal end. The first and second outer pole pieces each have an attachment slot formed across its outermost side proximate its distal end. A coil of electric wire is disposed around the central pole piece, the wire having at least first and second ends extending from the coil to form respective first and second leads. The first and second leads are electrically connected to the first and second terminals respectively. An electrical insulating member, or means, separates the coil from the stator core to prevent electrical contact therebetween. A molded insulating cover is bonded to at least the stator core and substantially envelopes the solenoid stator assembly except for portions of the first and second terminals and the faces of the first and second outer pole pieces and of the central pole piece. The cover is molded into the attachment slots in the first and second outer pole pieces to enhance adherence of the cover material to the first and second outer pole pieces and to provide a tortuous path to inhibit the flow of errant fuel.

In the preferred construction of the invention, the outer pole pieces are prestressed by wedging a flange between them to apply a force proximate the distal end of the first outer pole piece and a force proximate the distal end of the second outer pole piece, the forces acting in generally coincident but opposite directions to bias the first and second outer pole pieces away from each other. The prestressing provides the first and second outer pole pieces with restorative forces to oppose any additional, parallel forces applied to the first and second outer pole pieces and inhibit additional displacement caused thereby.

In the preferred construction disclosed, the attachment slot formed in each of the outer pole pieces has a T-shaped cross section. The shape of the attachment slot enhances its ability to anchor the assembly-enclosing insulating cover and simultaneously provides a formidable barrier to fuel that might otherwise be forced under pressure between the cover and an outer pole piece, particularly when preloaded as aforementioned.

In the preferred construction of the invention, a spool is used to provide electrical insulation between the wires of the coil and the central pole piece of the stator core. The spool additionally provides a convenient form upon which the coil is wound, preferably in three layers, and facilitates positioning the coil on the central pole piece. Another advantage is gained in the area of quality control by using the spool. A lead from the top layer of the coil may be secured by passing it between the coil and the spool so that the wires of the coil hold the lead against the spool. With the lead secured in this manner, no tape or shim is required to prevent the coil from unwinding or to prevent the lead from electrically contacting another element such as an outer pole piece; and the interior of the stator-coil subassembly may be completely filled with phenolic during the molding process.

In the preferred construction, an insulating cap is disposed on the stator core proximate the top portion thereof. The cap receives the first and second terminals and maintains them in position while the insulating cover is being molded around the solenoid stator assembly.

As disclosed, the outer pole pieces may be prestressed by having a first wedging member, preferably made of metal, disposed between the first outer pole piece and the central pole piece proximate their respective distal ends and a second wedging member disposed between the second outer pole piece and the central pole piece proximate their respective distal ends. The first and second wedging members have dimensions that exceed, by specific amounts, respective distances between the first and second outer pole pieces and the central pole piece when the first and second outer pole pieces are unbiased.

In an alternate construction, the coil is wound on a bobbin disposed around the central pole piece. The bobbin has a flange at each of its ends that extends orthogonally toward the first and second outer pole pieces. In this construction, shims, preferably made of a plastic material, are forced between the bobbin flanges and the first and second outer pole pieces, urging them away from the central pole piece and prestressing them.

In the preferred construction as disclosed, the spool has an end flange that extends from the first outer pole piece proximate its distal end to the second outer pole piece proximate its distal end. The portion of the flange that is disposed between the first and second outer pole pieces has a dimension that exceeds, by a specific amount, the associated distance between the first and second outer pole pieces when the first and second outer pole pieces are unbiased. When inserted, the flange applies a force proximate the distal end of the first outer pole piece and a force proximate the distal end of the second outer pole piece, the forces acting in generally coincident but opposite directions to bias the first and second outer pole pieces away from the central pole piece and prestress the first and second outer pole pieces with restorative forces to oppose additional, fuel-pressure related, parallel forces that might be applied to the first and second outer pole pieces and inhibit additional displacement caused thereby.

In the preferred construction of the invention, each of the faces of the first and second outer pole pieces has a locating ridge extending along a margin adjacent to the central pole piece to facilitate positioning the stator core during a subsequent assembly process. The locating ridge has an edge adjacent to the central pole piece, the edge being chamfered to facilitate inserting the flange of the spool between the first and second outer pole pieces. The locating ridge is removed, for example, by grinding, during the process of completing the solenoid stator assembly.

The insulating covers of previously constructed solenoid stator assemblies did not completely seal the spaces around the pole pieces, allowing fuel under pressure to gain access to internal spaces of the solenoid stator assembly. This sometimes resulted in the insulating cover fracturing. In the preferred construction of the invention, the insulating cover completely isolates the internal spaces of the solenoid stator assembly from fuel.

The objects described in the foregoing, and other objects, features, and advantages of the present invention, are readily apparent from the following detailed description of the best mode for carrying out the invention when taken in connection with the accompanying drawings.

BEST MODE FOR CARRYING OUT THE INVENTION

Figure 1:
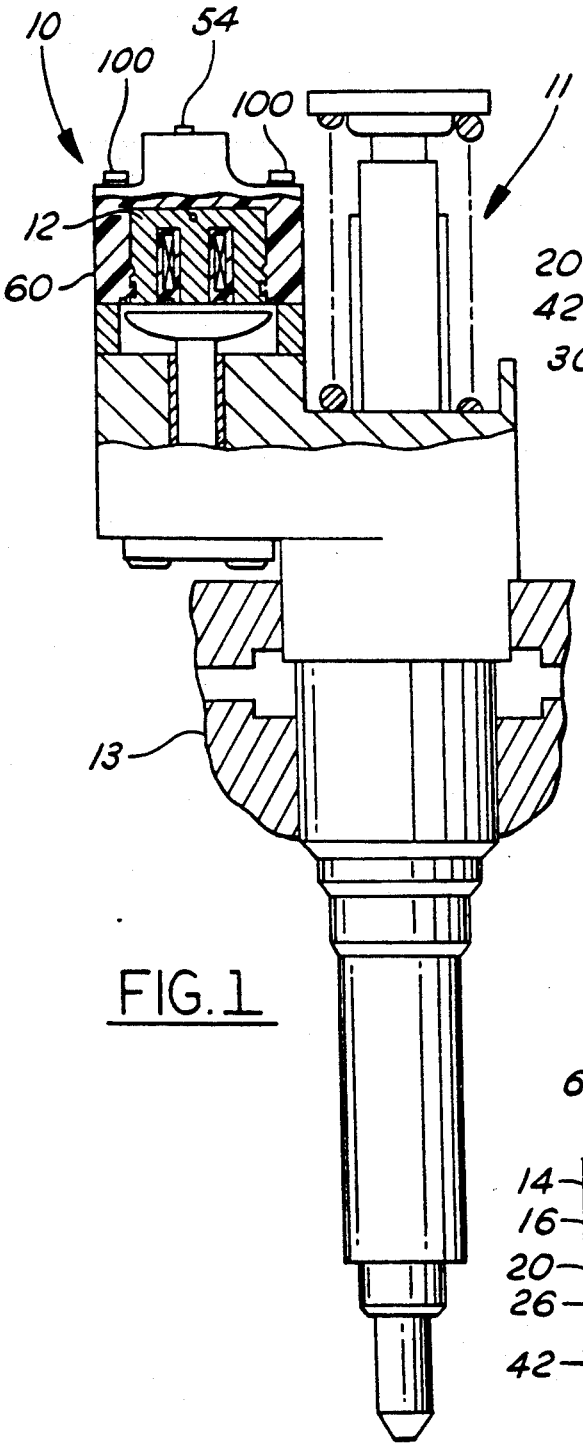
FIG. 1 is a side view, partially in section, of an electromechanically actuated fuel injector including the primary operating elements of a solenoid stator assembly as seen in side view and constructed in accordance with the present invention.
Figure 2:
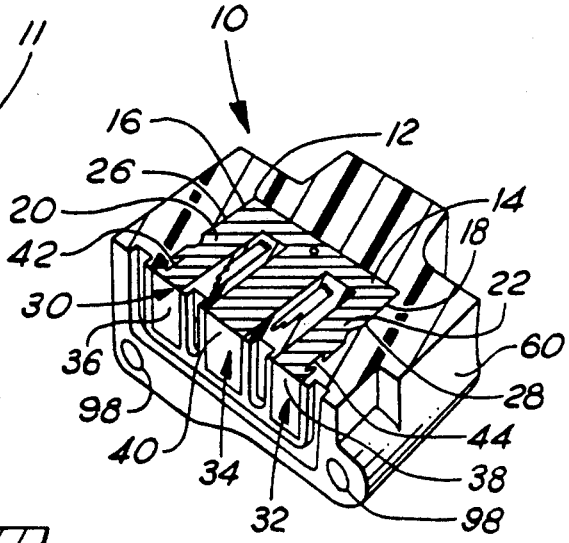
FIG. 2 is a perspective view of the solenoid stator assembly shown completely sectioned along the same front-to-back plane as in the partially sectioned view in FIG. 1.
Figure 3:
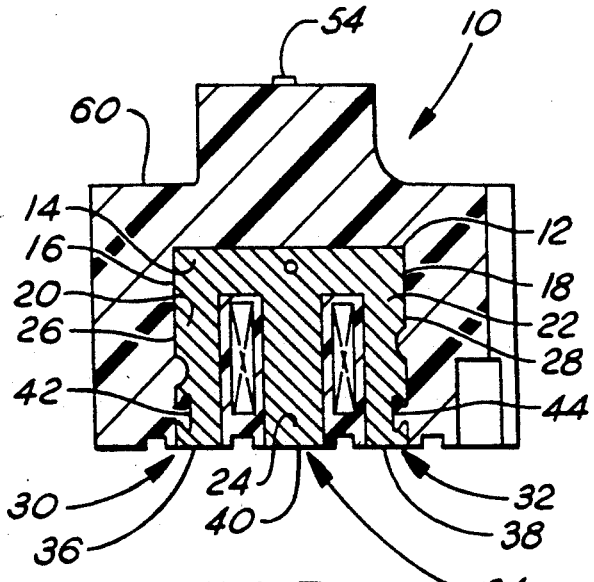
FIG. 3 is an enlarged side view, partially in section of the solenoid stator assembly of FIG. 1.

With reference to FIG. 1 of the drawings, a solenoid stator assembly, generally indicated by reference numeral 10, is shown as an effective element of a representative electromechanically actuated fuel injector, generally indicated by reference numeral 11, mounted in an engine 13. As shown in FIGS. 2 and 3 of the drawings, the stator assembly 10 has an E-shaped stator core 12 that includes a top portion, generally indicated by reference numeral 14, having a first end 16 and a second end 18. A first outer pole piece 20 extends substantially orthogonally from the first end 16 of the top portion 14, a second outer pole piece 22 extends from the second end 18 of the top portion 14 in a direction substantially parallel to that of the first outer pole piece 20, and a central pole piece 24 extends from a region of the top portion located central to the first and second outer pole pieces, 20 and 22 respectively, and in a direction substantially parallel to those of the first and second outer pole pieces 20 and 22. In the preferred construction of the invention, the stator core is laminated, containing approximately 50 laminae, each being shaped as shown in FIG. 1 and aligned side to side.

The first and second outer pole pieces 20 and 22 each have an outermost side 26 and 28 respectively; and the first and second outer pole pieces 20 and 22 and the central pole piece 24 each have a distal end, generally indicated by reference numerals 30, 32 and 34 respectively, faces 36, 38 and 40 being formed across respective distal ends 30, 32 and 34. The first outer pole piece 20 has an attachment slot 42 formed across its outermost side 26 proximate its distal end 30 and substantially parallel to the top portion 14 of the stator core 12. The second outer pole piece 22 has an attachment slot 44 formed in a like manner across its outermost side 28 proximate its distal end 32.

The attachment slots 42 and 44 may have a number of configurations, each of which may be produced as part of the initial blanking step in forming the laminations on a punch press. For example, the attachment slots 42 and 44 may each be rectangular in cross section (not shown); and their sides may be at right angles relative to the outermost sides 26 and 28 of the first and second outer pole pieces 20 and 22 respectively. The attachment slots 42 and 44 may also each be dovetail-shaped in cross section (not shown). Alternatively, the sides of the attachment slots 42 and 44 may each define an acute angle relative to the outermost sides 26 and 28 and angle toward the top portion 14 of the stator core 12. The attachment slots 42 and 44 that have dovetail-shaped or angled cross sections provide, among other advantages, that of offering substantial resistance, in addition to that offered by chemical bonding of an insulating cover 60 to the outer pole pieces 20 and 22, to any forces acting to pull the insulating cover 60 away from the outer pole pieces 20 and 22.

Figure 4:
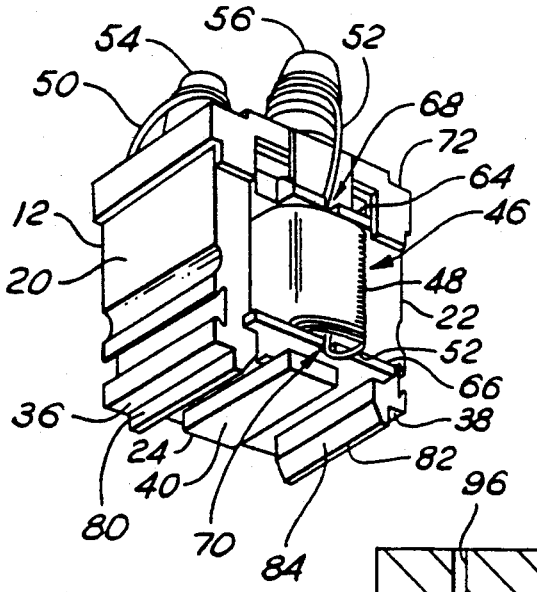
FIG. 4 is a perspective view of the solenoid stator assembly of FIG. 1 shown without an insulating cover.

While it should be understood that a variety of configurations can be used, in the preferred construction, and as best shown in FIG. 4 of the drawings, each of the attachment slots 42 and 44 has a generally T-shaped cross section. The shape of the attachment slots 42 and 44 enhances their ability to anchor the assembly-enclosing insulating cover and simultaneously provide formidable barriers to fuel that might otherwise be forced under pressure between the insulating cover 60 and the outer pole pieces 20 and 22.

Figure 7:
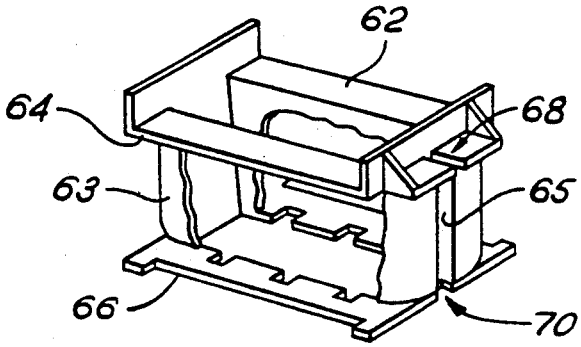
FIG. 7 is a perspective view of a spool, partly broken away, that is constructed in accordance with the present invention and that is an element of the solenoid stator assembly of FIG. 4.

As shown in FIG. 4 of the drawings, a coil, generally indicated by reference numeral 46, of electric wire 48 is disposed around the central pole piece 24, the wire 48 having at least first and second ends extending from the coil 46 to form a respective first lead 50 and second lead 52. The first and second leads 50 and 52 respectively are electrically connected to at least a first terminal 54 and a second terminal 56. An electrical insulating member, or means, separates the coil 46 from the stator core 12 to prevent electrical contact with the central pole piece 24. In one embodiment of the solenoid stator assembly 10, the insulating member may be in the form of a spool 62 (shown in FIG. 7 and hereinafter described) that generally surrounds the central pole piece 24 and around which the coil 46 is disposed.

With reference again to FIGS. 1, 2 and 3 of the drawings, the molded insulating cover 60 is bonded to at least the stator core 12 and substantially envelopes the solenoid stator assembly 10 except for upper portions of the first and second terminals, 54 and 56 (FIG. 4 of the drawings) respectively, and the respective faces 36, 38 and 40 of the first and second outer pole pieces 20 and 22 and of the central pole piece 24. The cover 60 is molded into the respective attachment slots 42 and 44 in the first and second outer pole pieces 20 and 22 to enhance adherence of the cover material to the first and second outer pole pieces 20 and 22 and to provide a tortuous path to inhibit the flow of errant fuel.

Figure 5:
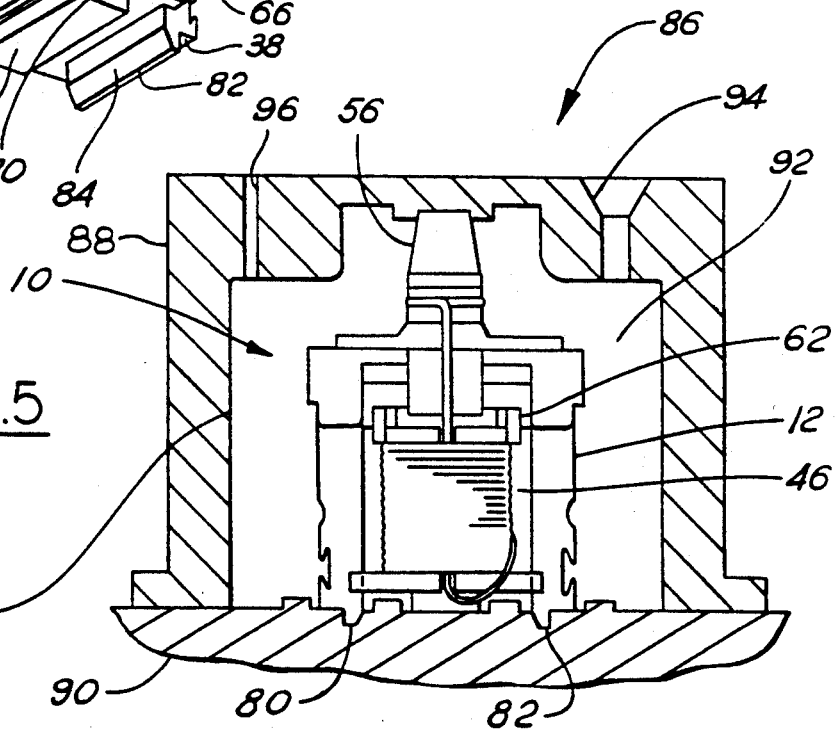
FIG. 5 is a view, partially in section, of the solenoid stator assembly of FIG. 4 shown positioned in a mold prior to receiving an insulating cover.

FIG. 5 of the drawings shows the solenoid stator assembly lo positioned in a representative mold, generally indicated by reference numeral 86, prior to having an insulating cover 60 (FIG. molded thereabout. The mold 86 includes an upper portion 88 and a base portion 90 that define a mold cavity, generally indicated by reference numeral 92, therebetween. An inlet, or gate, 94, through which molten material of which the insulating cover 60 is to be formed is introduced, is disposed in the upper portion 88 of the mold 86; and an associated vent 96 is also disposed therein. While it should be understood that the insulating cover 60 may be formed of any of a number of moldable, electrically insulating materials, that used in the preferred construction herein disclosed is a phenolic having low swell characteristics when exposed to various fuels, particularly methanol fuel and to a lesser extent diesel fuel. Rogers Rx 630 phenolic, produced by the Fiberite Company is particularly useful.

The outer pole pieces 20 and 22 are prestressed by applying a force proximate the distal end 30 of the first outer pole piece 20 and a force proximate the distal end 32 of the second outer pole piece 22, the forces acting in generally coincident but opposite directions to bias the first and second outer pole pieces 20 and 22 away from each other. The prestressing provides the first and second outer pole pieces 20 and 22 with restorative forces to oppose any additional, parallel forces applied to the first and second outer pole pieces 20 and 22 and inhibit additional displacement caused thereby.

Figure 6:
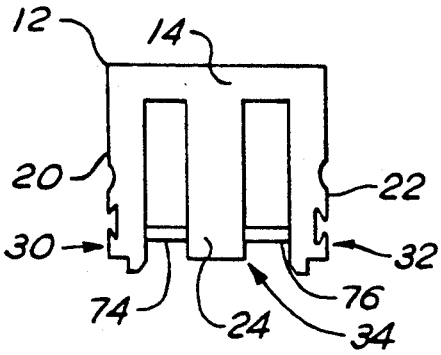
FIG. 6 is a view of prestressing wedges constructed in accordance with an embodiment of the present invention.

With reference to FIG. 6 of the drawings, the first and second outer pole pieces 20 and 22 may be prestressed by having a first wedging member 74 disposed between the first outer pole piece 20 and the central pole piece 24 proximate their respective distal ends 30 and 34 and a second wedging member 76 disposed between the second outer pole piece 22 and the central pole piece 24 proximate their respective distal ends 32 and 34. The first and second wedging members 74 and 76 have dimensions that exceed, by specific amounts, respective distances between the first and second outer pole pieces 20 and 22 and the central pole piece 24 when the first and second outer pole pieces 20 and 22 are unbiased. While it should be understood that the amount of prestressing may vary as a function of solenoid application and that a certain degree of relaxation or shrinkage of the wedges will occur during the molding of the insulating cover, the outer pole pieces 20 and 22 of the preferred construction herein disclosed will have a final prestress force ranging between 250 and 750 pounds (1100 and 3350 Newtons) and preferably have a force of 500 pounds (2225 Newtons).

With reference again to FIG. 4, in the preferred construction of the solenoid stator assembly 10, an insulating spool 62 (shown in detail in FIG. 7 of the drawings) is used to provide electrical insulation between the coil 46 and the central pole piece 24 of the stator core 12. The spool 62 additionally provides a convenient form upon which the coil 46 may be wound and facilitates positioning the coil 46 on the central pole piece 24.

The spool 62 has an elongate drum portion 63 from one end of which orthogonally extends a first end flange 64 and from the other end of which orthogonally extends a second end flange 66. The first end flange 64 defines along its peripheral edge a pair of diametrically opposed notches, generally indicated by reference numeral 68, to provide respective paths for the first and second leads 50 and 52. The second end flange 66 defines along its peripheral edge at least one notch, generally indicated by reference numeral 70, to provide a path for the second lead 52. The drum portion 63 defines in its outer surface at least one channel 65 extending from a notch 68 in the first end flange 64 to notch 70 of the second end flange 66. In the preferred construction of the spool 62, the notches 68 and 70 in the first and second end flanges 64 and 66 respectively, and the interconnecting channel 65 will be provided at both sides of the spool 62 and arranged symmetrically about the peripheral edges thereof to facilitate assembly. While it should be understood that the spool 62 may be formed of any of a number of electrically insulating materials, that used in the preferred construction herein disclosed is a phenolic having low swell characteristics when exposed to various fuels, particularly methanol fuel and to a lesser extent diesel fuel. Fiberite FM 4004 phenolic, as produced by the Fiberite Company, is particularly useful.

The coil 46 is preferably wound in three layers, the first layer being started at the end of drum portion 63 of the spool 62 that is proximate the first end flange 64 thereof, the third layer being completed at the end of the drum portion 63 that is proximate the second end flange 66 of the spool 62. The first lead 50 is routed to the first terminal 54 through a notch 68 in the first end flange 64. The second lead 52 is routed under the coil 46 at the notch 70 in the second end flange 66, along a channel 65 in the drum portion 63 of the spool 62, and through the other notch 68 in the first end flange 64 to the second terminal 56.

In providing the capability of routing the second lead 52 between the coil 46 and the spool 62, the latter provides a significant advantage over devices requiring more conventional lead routing practices. With the second lead 52 secured beneath the coil in the manner disclosed, no tape or other fastening device is required to prevent the coil 46 from unwinding or to prevent the second lead 52 from contacting another element such as a first or second outer pole piece 20 or 22.

An insulating cap 72 is disposed on the stator core 12 proximate the top portion 14 thereof. The cap 72 is formed with recesses to receive the first and second terminals 54 and 56 and maintains them in position while the insulating cover 60 is being molded around the solenoid stator assembly 10. Portions of the insulating cap 72 overlap associated portions of the spool 62 to provide an insulating barrier between the first and second leads 50 and 52 respectively and the stator core 12. While it should be understood that the insulating cap 72 may be formed of any of a number of electrically insulating materials, that used in the preferred construction herein disclosed is a phenolic having low swell characteristics, preferably the same phenolic as used for the spool 62, to provide complete compatibility during the molding of the housing 60.

Figure 8:
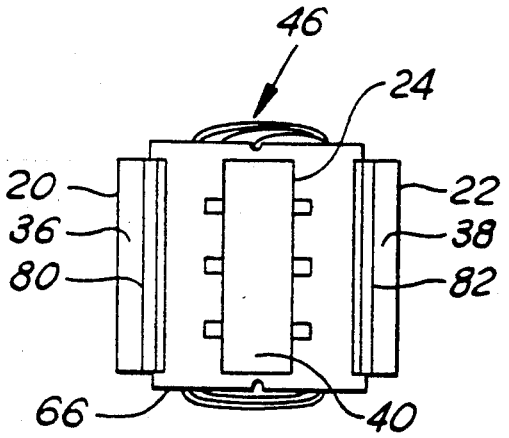
FIG. 8 is a bottom view of the solenoid stator assembly of FIG. 4.

The second end flange 66 of the spool 62 extends from the first outer pole piece 20 proximate its distal end 30 to the second outer pole piece 22 proximate its distal end 32. The portion of the second end flange 66 that is disposed between the first outer pole piece 20 and second outer pole piece 22 has a dimension that exceeds, by a specific amount, the associated distance between the first and second outer pole pieces 20 and 22 when the first and second outer pole pieces 20 and 22 are unbiased. This is shown in detail in FIGS. 8 and 9. When inserted, the second end flange 66 applies a force proximate the distal end 30 of the first outer pole piece 20 and a force proximate the distal end 32 of the second outer pole piece 22, the forces acting in generally coincident but opposite directions to bias the first and second outer pole pieces 20 and 22 away from the central pole piece 24 and prestress the first and second outer pole pieces 20 and 22 with restorative forces to oppose any additional, parallel forces that might be applied to the first and second outer pole pieces 20 and 22 and inhibit additional displacement caused thereby.

Figure 9:
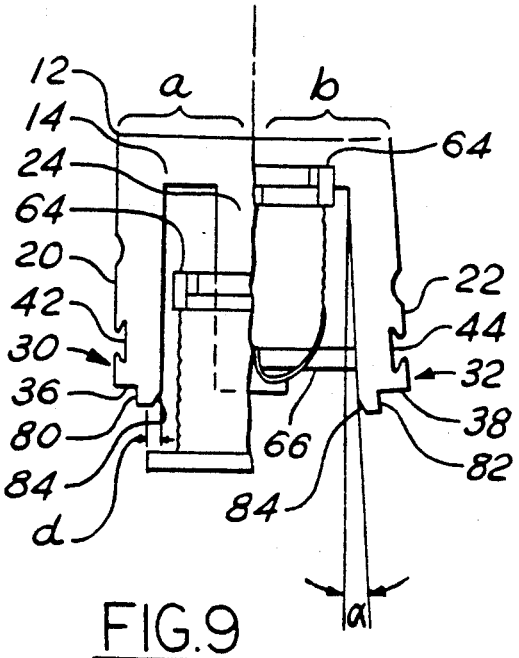
FIG. 9 is a split, sectional, side view of the stator core of FIG. 4 illustrating the prestressing of the stator core in accordance with the present invention.

Side (a) of FIG. 9 shows the stator core 12 before the spool 62 is fully inserted onto the central pole piece 24 thereof. As shown, the second end flange 66 of the spool 62 extends a specific distance d beyond the inner surface of the first outer pole piece 20. Side (b) of FIG. 9 shows the stator core 12 after the spool 62 has been fully inserted. As shown, the second end flange 66 has displaced the second outer pole piece 22 away from the central pole piece 24 by an angle $\alpha$. It is as a result of the displacing action of the second end flange 66 that the first and second outer pole pieces 20 and 22 are prestressed. To facilitate positioning the second end flanges 66 between the first and second outer pole pieces 20 and 22, the distal ends 30 and 32 respectively thereof may be spread using the T-shaped slots 42 and 44 disposed therein to anchor force-applying members (not shown).

Each of the faces 36 and 38 of the first and second outer pole pieces 20 and 22 has a respective locating ridge 80 and 82 extending along a margin adjacent to the central pole piece 24 to facilitate positioning the stator core 12 during a subsequent assembly process. Each locating ridge 80 and 82 has an edge 84 adjacent to the central pole piece 24, the edge 84 being chamfered to facilitate inserting the second end flange 66 of the spool 62 between the first and second outer pole pieces 20 and 22. The locating ridges 80 and 82 are removed, for example, by grinding, during the process of completing the solenoid stator assembly 10.

It should be understood that practical features, such as sleeves passing through the insulating cover 60, may be included to provide holes 98 (FIG. 2) through which mounting screws 100 (FIG. 1) may be disposed to secure the solenoid stator assembly 10 to an electromechanically actuated fuel injector 11.

Figure 10:
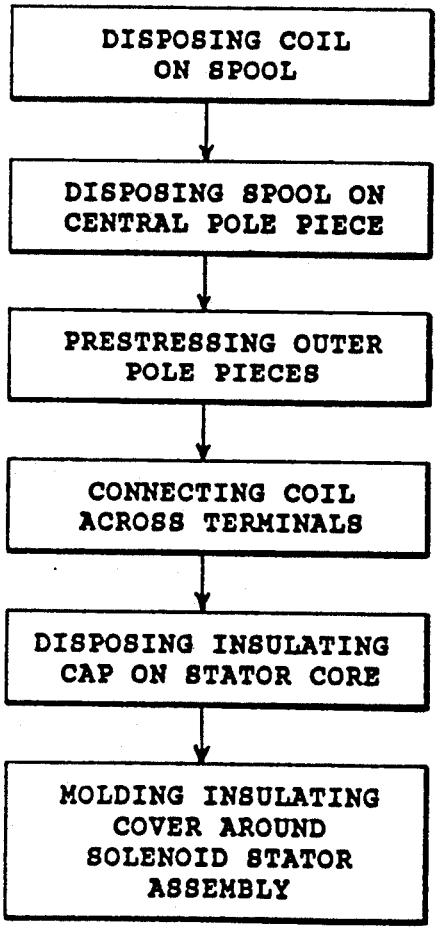
FIG. 10 is a schematic view that illustrates the steps of producing the solenoid stator assembly of FIG. 3.

The method for producing a preferred embodiment of the solenoid stator assembly can best be understood with reference to the steps outlined in FIG. 10 of the drawings in conjunction with previously described FIGS. 4 through 9. A coil 46 of electric wire 48 is disposed around the insulating spool 62. The coil 46 is preferably wound in three layers. The first layer is started at the end of the drum portion 63 of the spool 62 that is proximate the first end flange 64 thereof, and the third layer is completed at the end of the drum portion 63 that is proximate the second end flange 66 of the spool 62. The spool 62 is slid, with the first end flange 64 leading, onto the central pole piece 24 of the stator core 12 until the second end flange 66 contacts the locating ridges 80 and 82 on the first and second outer pole pieces 20 and 22 respectively.

The distal ends 30 and 32 of the first and second outer pole pieces 20 and 22 respectively may be spread, using the T-shaped slots 42 and 44 disposed therein to anchor force-applying members (not shown), to facilitate passing the second end flange 66 between the first and second pole pieces 20 and 22. The chamfered edges 84 of the locating ridges 80 and 82 also facilitate inserting the second end flange 66 into position.

With the spool 62 in place on the central pole piece 24, the insulating cap 72 is disposed on the stator core 12 proximate the top portion 14 thereof. The first and second leads 50 and 52 are electrically connected to the first and second terminals 54 and 56 respectively, and the first and second terminals 54 and 56 are disposed in the recesses formed in the insulating cap 72. The first lead 50 is routed to the first terminal 54 through a notch 68 in the first end flange 64. The second lead 52 is routed under the coil 46 at the notch 70 in the second end flange 66, along the channel 65 in the drum portion 63 of the spool 62, and through another notch 68 in the first end flange 64 to the second terminal 56.

After the stator core 12, spool 62, coil 46, insulating cap 72 and terminals 54 and 56 have been assembled as described, they are placed in the mold 86 as represented in FIG. 5. The assembly 10 is positioned on the base portion 90 of the mold 86 so that the locating ridges 80 and 82 are disposed in associated recesses formed in the base portion 90 of the mold 86. The upper portion 88 of the mold 86 is then disposed atop the base portion 90 thereof, forming a mold cavity 92 around the assembly 10. Molten insulating material, which, in the preferred construction of the invention, is phenolic, is introduced to the mold 86 through the inlet, or gate, 94 to form an insulating cover 60 (FIGS. 1 through 3), gasses produced during the molding operation being exhausted from the mold cavity 92 through the associated vent 96 in the upper portion 88 of the mold 86.

The insulating material is bonded to at least the stator core 12 and substantially envelopes the solenoid stator assembly 10 except for portions of the first and second terminals 54 and 56, the faces 36 and 38 of the first and second outer pole pieces 20 and 22 respectively and the face 40 of the central pole piece 24. When the insulating cover 60 has set sufficiently, the upper portion 88 of the mold 86 is separated from the base portion 90 thereof; and the solenoid stator assembly 10 is removed from the mold 86. The locating ridges 80 and 82 are removed from their respective first and second outer pole pieces 20 and 22 by a machining process such as grinding.

While the best mode for carrying out the invention has been described in detail, those familiar with the art will recognize various alternative designs and embodiments as being part of the invention. For example, while the foregoing has been limited to describing the invention as applied to a solenoid stator assembly having an E-shaped stator core, one skilled in the art will recognize its application to a solenoid stator assembly having a C-shaped stator. Thus it is intended that the invention be recognized as defined by the following claims.

What is claimed is:

1. A solenoid stator assembly for electronically actuated fuel injectors, the solenoid stator assembly comprising:

a stator core including a top portion having a first end and a second end, a first outer pole piece extending substantially orthogonally from the first end of the top portion, a second outer pole piece extending from the second end of the top portion in a direction substantially parallel to that of the first outer pole piece, the first and second outer pole pieces each having an outermost side and a distal end, a face being formed across each distal end, the first and second outer pole pieces each having an attachment slot formed across its outermost side proximate its distal end, the slot being substantially parallel to the top portion;

a coil of electric wire disposed about any one of the top portion and pole pieces, the wire having at least first and second ends extending from the coil to form respective first and second leads;

first and second terminals electrically connected to the first and second leads respectively;

electrical insulating means for separating the coil from said one of the top portion and pole pieces to prevent electrical contact therebetween; and an insulating cover bonded to at least the stator core and substantially enveloping the solenoid stator assembly except for portions of the first and second terminals and the faces of the first and second outer pole pieces, the cover being molded into the attachment slots in the first and second outer pole pieces to enhance adherence of the cover to the first and second outer pole pieces.

2. The solenoid stator assembly as defined by claim 1, wherein the attachment slot formed across each of the outermost sides of the first and second outer pole pieces proximate their respective distal ends has a T-shaped cross section.

3. The solenoid stator assembly as defined by claim 1, further comprising an insulating cap disposed on the stator core proximate the top portion thereof to receive the first and second terminals and to maintain the first and second terminals in position while the insulating cover is being molded around the solenoid stator assembly.

4. The solenoid stator assembly as defined by claim 3, wherein the insulating cap is formed of phenolic material.

5. The solenoid stator assembly as defined by claim 1 further including prestressing means for applying a force proximate the distal end of the first outer pole piece and a force proximate the distal end of the second outer pole piece, the forces acting in generally coincident but opposite directions to bias the first and second outer pole pieces away from each other.

6. A solenoid stator assembly for, electronically actuated fuel injectors, the solenoid stator assembly comprising:

an E-shaped stator core including a top portion having a first end and a second end, a first outer pole piece extending substantially orthogonally from the first end of the top portion, a second outer pole piece extending from the second end of the top portion in a direction substantially parallel to that of the first outer pole piece, and a central pole piece extending from a region of the top portion located central to the first and second outer pole pieces and in a direction substantially parallel to those of the first and second outer pole pieces, the first and second outer pole pieces each having an outermost side and the first and second outer pole pieces and the central pole piece each having a distal end, a face being formed across each distal end, the first and second outer pole pieces each having an attachment slot formed across its outermost side proximate its distal end, the slot being substantially parallel to the top portion;

a coil of electric wire disposed about the central pole piece, the wire having at least first and second ends extending from the coil to form respective first and second leads;

first and second terminals electrically connected to the first and second leads respectively;

electrical insulating means for separating the coil from the central pole piece to prevent electrical contact therebetween; and an insulating cover bonded to at least the stator core and substantially enveloping the solenoid stator assembly except for portions of the first and second terminals and the faces of the first and second outer pole pieces and of the central pole piece, the cover being molded into the attachment slots in the first and second outer pole pieces to enhance adherence of the cover to the first and second outer pole pieces.

7. The solenoid stator assembly as defined by claim 6, wherein the attachment slot formed across each of the outermost sides of the first and second outer pole pieces proximate their respective distal ends has a T-shaped cross section.

8. The solenoid stator assembly as defined by claim 6, wherein the electrical insulating means for separating the coil from the central pole piece includes a spool disposed around the central pole piece and between the central pole piece and the coil of electric wire.

9. The solenoid stator assembly as defined by claim 8, wherein the coil has a first end and a second end, the first lead extending from the first end of the coil, the second lead extending from the second end of the coil, between the coil and the spool, to the first end of the coil, the second lead being held in position against the spool by the coil without requiring additional security.

10. The solenoid stator assembly as defined by claim 8, wherein the spool is formed of phenolic material.

11. The solenoid stator assembly as defined by claim 6, wherein the insulating cover is molded in situ of phenolic material.

12. The solenoid stator assembly as defined by claim 6, further comprising an insulating cap disposed on the stator core proximate the top portion thereof to receive the first and second terminals and to maintain the first and second terminals in position while the insulating cover is being molded around the solenoid stator assembly.

13. The solenoid stator assembly as defined by claim 12, wherein the insulating cap is formed of phenolic material.

14. A solenoid stator assembly for electronically actuated fuel injectors, the solenoid stator assembly comprising:

an E-shaped stator core including a top portion having a first end and a second end, a first outer pole piece extending substantially orthogonally from the first end of the top portion, a second outer pole piece extending from the second end of the top portion in a direction substantially parallel to that of the first outer pole piece, and a central pole piece extending from a region of the top portion located central to the first and second outer pole pieces and in a direction substantially parallel to those of the first and second outer pole pieces, the first and second outer pole pieces and the central pole piece each having a distal end, a face being formed across each distal end;

a coil of electric wire disposed around the central pole piece, the wire having at least first and second ends extending from the coil to form respective first and second leads;

first and second terminals electrically connected to the first and second leads respectively;

electrical insulating means for separating the coil from the central pole piece to prevent electrical contact therebetween;

prestressing means for applying a force proximate the distal end of the first outer pole piece and a force proximate the distal end of the second outer pole piece, the forces acting in generally coincident but opposite directions to bias the first and second outer pole pieces away from each other; and an insulating cover bonded to at least the stator core and substantially enveloping the solenoid stator assembly except for portions of the first and second terminals and the faces of the first and second outer pole pieces and of the central pole piece.

15. The solenoid stator assembly as defined by claim 14, wherein the electrical insulating means for separating the coil from the central pole piece includes a spool disposed around the central pole piece and between the central pole piece and the coil of electric wire.

16. The solenoid stator assembly as defined by claim 15, wherein the coil has a first end and a second end, the first lead extending from the first end of the coil, the second lead extending from the second end of the coil, between the coil and the spool, to the first end of the coil, the second lead being held in position against the spool by the coil without requiring additional security.

17. The solenoid stator assembly as defined by claim 15, wherein the spool is formed of phenolic material.

18. The solenoid stator assembly as defined by claim 14, wherein the insulating cover is molded in situ of phenolic material.

19. The solenoid stator assembly as defined by claim 14, further comprising an insulating cap disposed on the stator core proximate the top portion thereof to receive the first and second terminals and to maintain the first and second terminals in position while the insulating cover is being molded around the solenoid stator assembly.

20. The solenoid stator assembly as defined by claim 19, wherein the insulating cap is formed of phenolic material.

21. The solenoid stator assembly as defined by claim 14, wherein the prestressing means comprises:

a first wedging member disposed between the first outer pole piece and the central pole piece proximate their respective distal ends; and a second wedging member disposed between the second outer pole piece and the central pole piece proximate their respective distal ends, the first and second wedging members having dimensions that exceed, by specific amounts, respective distances between the first and second outer pole pieces and the central pole piece when the first and second outer pole pieces are unbiased, and the first and second wedging members being inserted into their respective positions to apply a force proximate the distal end of the first outer pole piece and a force proximate the distal end of the second outer pole piece, the forces acting in generally coincident but opposite directions to bias the first and second outer pole pieces away from the central pole piece and prestress the first and second outer pole pieces with restorative forces to oppose additional, parallel forces applied to the first and second outer pole pieces and inhibit additional displacement caused thereby.

22. The solenoid stator assembly of claim 14, wherein the prestressing means applies a force in a range of 250 to 750 pounds (1100 to 3350 Newtons) to the first and second outer pole pieces.

23. A solenoid stator assembly for electronically actuated fuel injectors, the solenoid stator assembly comprising:

an E-shaped stator core including a top portion having a first end and a second end, a first outer pole piece extending substantially orthogonally from the first end of the top portion, a second outer pole piece extending from the second end of the top portion in a direction substantially parallel to that of the first outer pole piece, and a central pole piece extending from a region of the top portion located central to the first and second outer pole pieces and in a direction substantially parallel to those of the first and second outer pole pieces, the first and second outer pole pieces each having an outermost side and the first and second outer pole pieces and the central pole piece each having a distal end, a face being formed across each distal end, the first and second outer pole pieces each having an attachment slot formed across its outermost side proximate its distal end, the slot being substantially parallel to the top portion;

a coil of electric wire disposed around the central pole piece, the wire having at least first and second ends extending from the coil to form respective first and second leads;

first and second terminals electrically connected to the first and second leads respectively;

electrical insulating means for separating the coil from the central pole piece to prevent electrical contact therebetween;

prestressing means for applying a force proximate the distal end of the first outer pole piece and a force proximate the distal end of the second outer pole piece, the forces acting in generally coincident but opposite directions to bias the first and second outer pole pieces away from each other; and an insulating cover bonded to at least the stator core and substantially enveloping the solenoid stator assembly except for portions of the first and second terminals and the faces of the first and second outer pole pieces and of the central pole piece, the cover being molded into the attachment slots in the first and second outer pole pieces to enhance adherence of the cover to the first and second outer pole pieces.

24. The solenoid stator assembly as defined by claim 23, wherein the attachment slot formed across each of the outermost sides of the first and second outer pole pieces proximate their respective distal ends has a T-shaped cross section.

25. The solenoid stator assembly as defined by claim 23, wherein the electrical insulating means for separating the coil from the central pole piece includes a spool disposed around the central pole piece and between the central pole piece and the coil of electric wire.

26. The solenoid stator assembly as defined by claim 25, wherein the coil has a first end and a second end, the first lead extending from the first end of the coil, the second lead extending from the second end of the coil, between the coil and the spool, to the first end of the coil, the second lead being held in position against the spool by the coil without requiring additional security.

27. The solenoid stator assembly as defined by claim 25, wherein the spool is formed of phenolic material.

28. The solenoid stator assembly as defined by claim 23, wherein the insulating cover is molded in situ of phenolic material.

29. The solenoid stator assembly as defined by claim 23, further comprising an insulating cap disposed on the stator core proximate the top portion thereof to receive the first and second terminals and to maintain the first and second terminals in position while the insulating cover is being molded around the solenoid stator assembly.

30. The solenoid stator assembly as defined by claim 29, wherein the insulating cap is formed of phenolic material.

31. The solenoid stator assembly as defined by claim 23, wherein the prestressing means comprises:

a first wedging member disposed between the first outer pole piece and the central pole piece proximate their respective distal ends; and a second wedging member disposed between the second outer pole piece and the central pole piece proximate their respective distal ends, the first and second wedging members having dimensions that exceed, by specific amounts, respective distances between the first and second outer pole pieces and the central pole piece when the first and second outer pole pieces are unbiased, and the first and second wedging members being inserted into their respective positions to apply a force proximate the distal end of the first outer pole piece and a force proximate the distal end of the second outer pole piece, the forces acting in generally coincident but opposite directions to bias the first and second outer pole pieces away from the central pole piece and prestress the first and second outer pole pieces with restorative forces to oppose additional, parallel forces applied to the first and second outer pole pieces and inhibit additional displacement caused thereby.

32. The solenoid stator assembly of claim 23, wherein the prestressing means applies a force in a range of 250 to 750 pounds (1100 to 3350 Newtons) to the first and second outer pole pieces.

33. A solenoid stator assembly for electronically actuated fuel injectors, the solenoid stator assembly comprising:

an E-shaped stator core including a top portion having a first end and a second end, a first outer pole piece extending substantially orthogonally from the first end of the top portion, a second outer pole piece extending from the second end of the top portion in a direction substantially parallel to that of the first outer pole piece, and a central pole piece extending from a region of the top portion located central to the first and second outer pole pieces and in a direction substantially parallel to those of the first and second outer pole pieces, the first and second outer pole pieces and the central pole piece each having a distal end, a face being formed across each distal end;

a coil of electric wire disposed around the central pole piece, the wire having at least first and second ends extending from the coil to form respective first and second leads;

first and second terminals electrically connected to the first and second leads respectively;

an electrically insulating spool disposed around the central pole piece and between the central pole piece and the coil of electric wire to prevent electrical contact therebetween, the spool having an end flange that extends from the first outer pole piece to the second outer pole piece proximate their respective distal ends, the portion of the end flange disposed between the first and second outer pole pieces having a dimension that exceeds, by a specific amount, the distance between the first and second outer pole pieces when the first and second outer pole pieces are unbiased, and the end flange being inserted into position to apply a force proximate the distal end of the first outer pole piece and a force proximate the distal end of the second outer pole piece, the forces acting in generally coincident but opposite directions to bias the first and second outer pole pieces away from the central pole piece and prestress the first and second outer pole pieces with restorative forces to oppose additional, parallel forces applied to the first and second outer pole pieces and inhibit additional displacement caused thereby; and an insulating cover bonded to at least the stator core and substantially enveloping the solenoid stator assembly except for portions of the first and second terminals and the faces of the first and second outer pole pieces and of the central pole piece.

34. The solenoid stator assembly of claim 33, wherein each of the faces of the first and second outer pole pieces has a locating ridge extending along a margin adjacent to the central pole piece to facilitate positioning the stator core in a mold, the locating ridge having an edge adjacent to the central pole piece, the edge being chamfered to facilitate inserting the end flange of the spool between the first and second outer pole pieces, the locating ridge being removed during the process of completing the solenoid stator assembly.

35. A solenoid stator assembly for electronically actuated fuel injectors, the solenoid stator assembly comprising:

an E-shaped stator core including a top portion having a first end and a second end, a first outer pole piece extending substantially orthogonally from the first end of the top portion, a second outer pole piece extending from the second end of the top portion in a direction substantially parallel to that of the first outer pole piece, and a central pole piece extending from a region of the top portion located central to the first and second outer pole pieces and in a direction substantially parallel to those of the first and second outer pole pieces, the first and second outer pole pieces each having an outermost side and the first and second outer pole pieces and the central pole piece each having a distal end, a face being formed across each distal end, the first and second outer pole pieces each having an attachment slot formed across its outermost side proximate its distal end, the slot being substantially parallel to the top portion;

a coil of electric wire disposed around the central pole piece, the wire having at least first and second ends extending from the coil to form respective first and second leads;

first and second terminals electrically connected to the first and second leads respectively;

an electrically insulating spool disposed around the central pole piece and between the central pole piece and the coil of electric wire to prevent electrical contact therebetween, the spool having an end flange that extends from the first outer pole piece to the second outer pole piece proximate their respective distal ends, the portion of the end flange disposed between the first and second outer pole pieces having a dimension that exceeds, by a specific amount, the distance between the first and second outer pole pieces when the first and second outer pole pieces are unbiased, and the end flange being inserted into position to apply a force proximate the distal end of the first outer pole piece and a force proximate the distal end of the second outer pole piece, the forces acting in generally coincident but opposite directions to bias the first and second outer pole pieces away from the central pole piece and prestress the first and second outer pole pieces with restorative forces to oppose additional, parallel forces applied to the first and second outer pole pieces and inhibit additional displacement caused thereby; and an insulating cover bonded to at least the stator core and substantially enveloping the solenoid stator assembly except for portions of the first and second terminals and the faces of the first and second outer pole pieces and of the central pole piece, the cover being molded into the attachment slots in the first and second outer pole pieces to enhance adherence of the cover to the first and second outer pole pieces.

36. The solenoid stator assembly of claim 35, wherein each of the faces of the first and second outer pole pieces has a locating ridge extending along a margin adjacent to the central pole piece to facilitate positioning the stator core in a mold, the locating ridge having an edge adjacent to the central pole piece, the edge being chamfered to facilitate inserting the end flange of the spool between the first and second outer pole pieces, the locating ridge being removed during the process of completing the solenoid stator assembly.

37. A method for producing a solenoid stator assembly having a stator core including a top portion having a first end and a second end, a first outer pole piece extending substantially orthogonally from the first end of the top portion, a second outer pole piece extending from the second end of the top portion in a direction substantially parallel to that of the first outer pole piece, the first and second outer pole pieces each having an outermost side and a distal end, a face being formed across the distal end, the first and second outer pole pieces each having an attachment slot formed across its outermost side proximate its distal end, the slot being substantially parallel to the top portion, the method comprising the steps of:

(a) disposing a coil of electric wire around an insulating spool;

(b) disposing the insulating spool and coil of wire about at least one of the pole pieces and the top portion;

(c) applying a permanent spreading force to the first and second outer pole pieces to prestress them;

(d) connecting the coil across at least two terminals; and (e) molding an insulating cover that bonds to at least the stator core and that substantially envelopes the solenoid stator assembly except for portions of the terminals and the faces of the first and second outer pole pieces.

38. The method as defined by claim 37, wherein the spreading force applied to the first and second outer pole pieces is in a range of 250 to 750 pounds (1100 to 3350 Newtons).

39. The method as defined by claim 37, wherein the insulating cover is molded in situ of phenolic material.

40. The method as defined by claim 37, wherein the spool is formed of phenolic material.

41. The method as defined by claim 37, wherein the attachment slot formed across each of the outermost sides of the first and second outer pole pieces proximate their respective distal ends has a T-shaped cross section.

42. The method as defined by claim 37, wherein the coil of wire disposed around the insulating spool has a first end and a second end, a first lead extending from the first end of the coil, a second lead being routed from the second end of the coil, between the coil and the spool, to emerge at the first end of the coil, the second lead being held in position against the spool by the coil without requiring additional security.

43. The method as defined by claim 37, further comprising the step of disposing an insulating cap on the stator pole proximate the top portion thereof to receive the at least two terminals, thereby maintaining the terminals in position while the insulating cover is being molded around the solenoid stator assembly.

44. The method as defined by claim 43, wherein the insulating cap is formed of phenolic material.

45. A method for producing a solenoid stator assembly having an E-shaped stator core including a top portion having a first end and a second end, a first outer pole piece extending substantially orthogonally from the first end of the top portion, a second outer pole piece extending from the second end of the top portion in a direction substantially parallel to that of the first outer pole piece, and a central pole piece extending from a region of the top portion located central to the first and second outer pole pieces and in a direction substantially parallel to those of the first and second outer pole pieces, the first and second outer pole pieces each having an outermost side and the first and second outer pole pieces and the central pole piece each having a distal end, a face being formed across the distal end, the first and second outer pole pieces each having an attachment slot formed across its outermost side proximate its distal end, the slot being substantially parallel to the top portion, the method comprising the steps of:

(a) disposing a coil of electric wire around an insulating spool;

(b) disposing the insulating spool and coil of wire about the central pole piece;

(c) applying a permanent spreading force to the first and second outer pole pieces to prestress them;

(d) connecting the coil across at least two terminals; and (e) molding an insulating cover that bonds to at least the stator core and that substantially envelopes the solenoid stator assembly except for portions of the terminals and the faces of the first and second outer pole pieces and of the central pole piece.

46. The method as defined by claim 45, wherein the spreading force applied to the first and second outer pole pieces is in a range of 250 to 750 pounds (1100 to 3350 Newtons).

47. The method as defined by claim 45, wherein the insulating cover is molded in situ of phenolic material.

48. The method as defined by claim 45, wherein the spool is formed of phenolic material.

49. The method as defined by claim 45, wherein the attachment slot formed across each of the outermost sides of the first and second outer pole pieces proximate their respective distal ends has a T-shaped cross section.

50. The method as defined by claim 45, wherein the coil of wire disposed around the insulating spool has a first end and a second end, a first lead extending from the first end of the coil, a second lead being routed from the second end of the coil, between the coil and the spool, to emerge at the first end of the coil, the second lead being held in position against the spool by the coil without requiring additional security.

51. The method as defined by claim 45, further comprising the step of disposing an insulating cap on the stator pole proximate the top portion thereof to receive the at least two terminals, thereby maintaining the terminals in position while the insulating cover is being molded around the solenoid stator assembly.

52. The method as defined by claim 51, wherein the insulating cap is formed of phenolic material.

53. The method as defined by claim 45, further comprising the step of providing the insulating spool with an end flange that extends from the first outer pole piece to the second outer pole piece proximate their respective distal ends, the portion of the end flange disposed between the first and second outer pole pieces having a dimension that exceeds, by a specific amount, the distance between the first and second outer pole pieces when the first and second outer pole pieces are unbiased, wherein the step of applying a permanent spreading force to the first and second outer pole pieces to prestress them includes inserting the end flange into position to apply a force proximate the distal end of the first outer pole piece and a force proximate the distal end of the second outer pole piece, the forces acting in generally coincident but opposite directions to bias the first and second outer pole pieces away from the central pole piece and prestress the first and second outer pole pieces with restorative forces to oppose additional, parallel forces applied to the first and second outer pole pieces and inhibit additional displacement caused thereby.

54. The method as defined by claim 53, wherein each of the faces of the first and second outer pole pieces has a locating ridge extending along a margin adjacent to the central pole piece to facilitate the step of positioning the stator core in a mold, the locating ridge having an edge adjacent to the central pole piece, the edge being chamfered to facilitate inserting the end flange of the spool between the first and second outer pole pieces.

55. The method defined by claim 54, further including the step of removing the locating ridge after the insulating cover is molded.

56. A system for producing a solenoid stator assembly having an E-shaped stator pole including a top portion having a first end and a second end, a first outer pole piece extending substantially orthogonally from the first end of the top portion, a second outer pole piece extending from the second end of the top portion in a direction substantially parallel to that of the first outer pole piece, and a central pole piece extending from a region of the top portion located central to the first and second outer pole pieces and in a direction substantially parallel to those of the first and second outer pole pieces, the first and second outer pole pieces each having an outermost side and the first and second outer pole pieces and the central pole piece each having a distal end, the first and second outer pole pieces each having an attachment slot formed across its outermost side proximate its distal end, the slot being substantially parallel to the top portion, the system comprising:

means for disposing a coil of electric wire around an insulating spool;

means for disposing the insulating spool and coil of wire on the central pole piece;

means for applying permanent spreading forces to the first and second outer pole pieces to prestress them;

means for connecting the coil across at least two terminals; and means for molding an insulating cover that bonds to at least the stator pole and that substantially envelopes the solenoid stator assembly except for portions of the terminals and the faces of the first and second outer pole pieces and of the central pole piece.

57. The system as defined by claim 56, wherein the spreading force applied to the first and second outer pole pieces is in a range of 250 to 750 pounds (1100 to 3350 Newtons).

58. The system as defined by claim 56, wherein the insulating cover is molded in situ of phenolic material.

59. The system as defined by claim 56, wherein the spool is formed of phenolic material.

60. The system as defined by claim 56, wherein the attachment slot formed across each of the outermost sides of the first and second outer pole pieces proximate their respective distal ends has a T-shaped cross section.

61. The system as defined by claim 56, wherein the coil of wire disposed around the insulating spool has a first end and a second end, a first lead extending from the first end of the coil, a second lead being routed from the second end of the coil, between the coil and the spool, to emerge at the first end of the coil, the second lead being held in position against the spool by the coil without requiring additional security.

62. The system as defined by claim 56, wherein the means for applying permanent spreading forces to the first and second outer pole pieces to prestress them comprises:

a first wedging member disposed between the first outer pole piece and the central pole piece proximate their respective distal ends; and a second wedging member disposed between the second outer pole piece and the central pole piece proximate their respective distal ends, the first and second wedging members having dimensions that exceed, by specific amounts, respective distances between the first and second outer pole pieces and the central pole piece when the first and second outer pole pieces are unbiased, and the first and second wedging members being inserted into their respective positions to apply a force proximate the distal end of the first outer pole piece and a force proximate the distal end of the second outer pole piece, the forces acting in generally coincident but opposite directions to bias the first and second outer pole pieces away from the central pole piece and prestress the first and second outer pole pieces with restorative forces to oppose additional, parallel forces applied to the first and second outer pole pieces and inhibit additional displacement caused thereby.

63. The system as defined by claim 56, wherein the insulating spool has an end flange that extends from the first outer pole piece to the second outer pole piece proximate their respective distal ends, the portion of the end flange disposed between the first and second outer pole pieces having a dimension that exceeds, by a specific amount, the distance between the first and second outer pole pieces when the first and second outer pole pieces are unbiased, and the end flange being inserted into position to apply a force proximate the distal end of the first outer pole piece and a force proximate the distal end of the second outer pole piece, the forces acting in generally coincident but opposite directions to bias the first and second outer pole pieces away from the central pole piece and prestress the first and second outer pole pieces with restorative forces to oppose additional, parallel forces applied to the first and second outer pole pieces and inhibit additional displacement caused thereby.

64. The system as defined by claim 63, wherein each of the faces of the first and second outer pole pieces has a locating ridge extending along a margin adjacent to the central pole piece to facilitate positioning the stator core in a mold, the locating ridge having an edge adjacent to the central pole piece, the edge being chamfered to facilitate inserting the end flange of the spool between the first and second outer pole pieces, the locating ridge being removed during the process of completing the solenoid stator assembly.

65. The system as defined by claim 56, further comprising means for receiving the at least two terminals and maintaining the at least two terminals in position while the insulating cover is being molded around the solenoid stator assembly.

66. The system as defined by claim 65, wherein the means for receiving the at least two terminals includes an insulating cap disposed on the stator pole proximate the top portion thereof to receive the at least two terminals and to maintain the at least two terminals in position while the insulating cover is being molded around the solenoid stator assembly.

67. The system as defined by claim 66, wherein the insulating cap is formed of phenolic material.

* * * * *